US005858960A

United States Patent [19]

Conroy et al.

[11] Patent Number: 5,858,960

[45] Date of Patent: Jan. 12, 1999

[54] FABRIC SOFTENING COMPOSITION

[75] Inventors: James Patrick Conroy, Wirral; Stephen Graham Hales, South Wirral; Abid Nadim Khan-Lodhi, Chester, all of United Kingdom

[73] Assignee: Lever Brothers Company, Division of Conopco, Inc., New York, N.Y.

[21] Appl. No.: 702,401

[22] Filed: Aug. 14, 1996

[30] Foreign Application Priority Data

Aug. 25, 1995 [GB] United Kingdom ..... 9517432

[51] Int. Cl.[6] ..... D06M 13/463

[52] U.S. Cl. ..... 510/521; 510/515; 510/519; 510/520; 510/522; 510/526; 510/527; 428/279

[58] Field of Search ..... 510/515, 519, 510/520, 522, 526, 527, 521; 428/279

[56] References Cited

U.S. PATENT DOCUMENTS

| | | | |
|---|---|---|---|
| 5,376,287 | 12/1994 | Borcher, Sr. et al. | 510/519 |
| 5,510,042 | 4/1996 | Hartman et al. | 510/515 |
| 5,559,088 | 9/1996 | Severns et al. | 510/520 |

FOREIGN PATENT DOCUMENTS

| | | |
|---|---|---|
| 0 239 910 | 3/1987 | European Pat. Off. . |
| 35 27 974 | 8/1985 | Germany . |
| 95/04802 | 2/1995 | WIPO . |
| WO 95/01498 | 8/1996 | WIPO . |

OTHER PUBLICATIONS

Marpat Abstract No. 124:320239 which is an abstract of PCT International Application No. 96/03370 (Feb./1996).
Marpat Abstract No. 125:251053 which is an abstract of Japanese Patent Application No. 8–198827 (Aug./1996).
Marpat Abstract No. 125:251054 which is an abstract of Japanese Patent Application No. 8–198828 (Aug./1996).
Marpat Abstract No. 125:303856 which is an abstract of Japanese Patent Application No. 8–232168 (Sep./1996).
Marpat Abstract No. 125:328092 which is an abstract of Japanese Patent Application No. 8–231478 (Sep./1996).

*Primary Examiner*—Anthony Green
*Attorney, Agent, or Firm*—Matthew Boxer

[57] ABSTRACT

A fabric softening composition comprising a compound of formula I

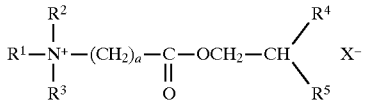

in which $R^1$, $R^2$ and $R^3$ are independently selected from $C_1$–$C_4$ alkyl groups or $C_2$–$C_4$ alkenyl groups, a is from 1 to 4, $x^-$ is a compatible anion and $R^4$ and $R^5$ are independently selected from $C_{12}$–$C_{22}$ alkyl or alkenyl groups, the sum of the chain lengths or $R^4$ and $R^5$ preferably being at least 30.

12 Claims, No Drawings

FABRIC SOFTENING COMPOSITION

This invention relates to fabric softening compositions comprising Guerbet alcohol betaine ester as softening compounds.

Biodegradable quaternary ammonium salts such as N,N-di(tallowoyloxyethyl)-N,N-dimethyl ammonium chloride and 1,2-ditallowoyloxy-3-trimethylammonium propane chloride have been developed as described in Patent EP 239 910 (Procter & Gamble).

Quaternary ammonium compounds from a betaine ester and an fatty alcohol have been disclosed for use in hair conditioning formulations in DE 35 27 974 (Wella). The fatty alcohol from which the conditioning agent is derived may have a branched or straight chain alkyl group.

It is an objective of the invention to provide novel fabric softening compositions which exhibit excellent softening properties.

The present invention provides a fabric softening composition comprising a compound of formula 1:

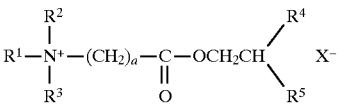

Formula 1 in which $R^1$, $R^2$ and $R^3$ are independently selected from $C_1$–$C_4$ alkyl groups or $C_2$–$C_4$ alkenyl groups, a is from 1 to 4, $X^-$ is a compatible anion and $R^4$ and $R^5$ are independently selected from $C_{12}$–$C_{22}$ alkyl or alkenyl groups, the sum of the chain lengths of $R^4$ and $R^5$ preferably being at least 30.

The invention further provides the use of the compound of formula 1 as a fabric softening agent.

Compositions according to the invention may be formulated in a variety of physical forms, such as liquid, solid, paste, granular, powder or in conjunction with a detergent active system for a single washing and softening product.

In liquid compositions excellent softening is achieved if the sum of the chain lengths of $R^4$ and $R^5$, of formula 1, is at least 30, preferably at least 32. The most preferred range for the sum of $R^4$ and $R^5$ is from 34 to 38.

For solid compositions without a dispersion agent the converse is true and it is preferred if the sum of the chain lengths of $R^4$ and $R^5$ is less then or equal to 32, as increased softening is achieved with shorter chain groups.

However, when using dispersion agents with the solid product the preferred chain lengths are as for liquids. Use of dispersion agents means any agent which aids dispersion of the fabric softening active such as urea and nonionic ethoxylates.

The compounds with which the present invention are concerned are Guerbet alcohol betaine esters. The Guerbet alcohol from which the betaine ester is derived need not be pure and may contain a distribution of alkyl chain lengths averaging to give a chain length in the desired range. However, it is desirable if the specific alcohol content (i.e the pure alcohol) is above 50%, that is to say no greater than 50% of the Guerbet alcohol has a single chain length. More preferably, the specific alcohol content is above 75% most preferably above 90%.

It is advantageous if the alkyl or alkenyl chains $R^4$ and $R^5$ in formula 1 are predominantly linear. Predominantly linear in the context of this invention means the chains are only branched at a level of 1% or below.

Furthermore it is advantageous if $R^4$and $R^5$ are alkyl groups.

To give improved hydrolytic stability it is preferred if $X^-$ is methosulphate, mesylate or iodide it is particularly preferred if $X^-$ is bromide.

The anion $X^-$ is preferably an anion of a strong acid.

Specific examples of suitable softening materials include betaine ester chlorides derived from the following Guerbet alcohols; 2-dodecylhexadecanol; 2-tetradecyloctadecanol; 2-teradecyleicosanol; 2-tetradecyloctadecanol; 2-hexadecyleisonanol.

Typically liquid fabric softening compositions according to the invention contains from 3 wt % to 50 wt % of the fabric softening compound. Compositions comprising up to 7% by weight of the fabric softening compound are considered dilute, compositions comprising from 7% to 30% by weight of fabric softening compound are considered to be concentrates.

Fabrics can also be softened by the use of sheets coated with the softening compound for use in tumble dryers.

Powders can be formulated using the fabric softening compound. The level of fabric softening compound in these powders can range from 30 wt % to 95 wt %.

If the compositions of the invention are liquids it is preferable if they comprise an aqueous base.

The compositions of the present invention may also comprise conventional fabric softening components to form a mixture of fabric softening actives. Such conventional softening agents include acyclic quaternary ammonium salts such as ditallowdimethylammonium salts, quaternary ammonium compounds having two $C_{12-18}$ alkyl or alkenyl groups connected to the molecule via at least one ester link such as 1,2 bis[hardened tallowoyloxy]-3- trimethylammonium propane chloride and $N^+$N-di(tallowoyl-oxy-ethyl) N,N-dimethyl ammonium chloride, cyclic quaternary ammonium salts, particularly those of the imidazolinium type, diamido quaternary ammonium salts, tertiary fatty amines having at least one and preferably two $C_8$ to $C_{30}$ alkyl chains, carboxylic acids having 8 to 30 carbon atoms and one carboxylic acid group per molecule, esters of polyhydric alcohols such as sorbitan esters or glycerolstearate, fatty alcohols, ethoxylated fatty alcohols, ethoxylated fatty amines, mineral oils, polyols such as polyethylene glycol, silicone oils and mixtures thereof.

For improved hydrolytic and rheological stability it is advantageous if the composition contains fatty acids for example $C_8$–$C_{24}$ alkyl or alkenyl monocarboxylic acids or polymers thereof. Preferably saturated fatty acids are used, in particular, hardened tallow $C_{16-18}$ fatty acids. Preferably the fatty acid is non-saponified, more preferably the fatty acid is free, for example oleic acid, lauric acid or tallow fatty acid.

Improved hydrolytic stability is also obtained if a fatty alcohol is present in the formulation, for example $C_8$–$C_{24}$alkyl or alkenyl alcohols. Mixtures of fatty alcohols and fatty acids are also acceptable.

The level of fatty acid material or fatty alcohol material is preferably more than 0.1% by weight, more preferably more than 0.2% by weight. Especially preferred are concentrates comprising from 0.5 to 20% by weight of fatty acid, more preferably 1% to 10% by weight.

It is further preferred if the level of fatty acid or fatty alcohol if from 0.1 to 50% of the weight quaternary ammonium compound of formula 1, more preferably from 1 to 25% by weight of the quaternary ammonium compound, of formula 1 most preferably from 10 to 20% of the quaternary ammonium compound of formula 1.

The compositions of the invention preferably have a pH of at least 2.0, more preferably from 2 to 5.

The composition can also contain one or more optional ingredients, selected from non-aqueous solvents, pH buffering agents, perfumes, perfume carriers, fluorescers colorants, hydrotropes, antifoaming agents, antiredeposition agents, enzymes, optical brightening agents, opacifiers, anti-shrinking agents, anti-wrinkle agents, anti-spotting agents, germicides, fungicides, anti-oxidants, anti-corrosion agents, drape imparting agents, antistatic agents and ironing aids.

The invention will now be illustrated by the following non-limiting examples. In the examples all percentages are expressed by weight.

Comparative Examples are designated by letters, while Examples of the invention are designated by numbers.

Preparation of Examples

The following liquid examples were prepared by adding the fabric softening compound to water at 80° C. and stirring the mixture to form a homogeneous dispersion.

The powdered examples were prepared by grinding the fabric softening compound to form a fine powder.

Softness Evaluation

Softening performance was evaluated by adding 0.1 g of softening active (2 ml of a 5% a.d. dispersion) to 1 litre of tap water, 10° FH., at ambient temperature containing 0.001% (w/w) sodium alkyl benzene sulphonate (ABS) in a tergotometer. The ABS was added to simulate carryover of anionic detergent from the main wash. Three pieces of terry towelling (8 cm×8 cm, 40 g total weight) were added to the tergotometer pot. The cloths were treated for 5 minutes at 65 rpm, spin dried to remove excess liquor and line dried overnight.

Softening of the fabrics was assessed by an expert panel of 4 people. Each panel member assessed two sets of test cloths. Each set of test cloths contained one cloth of each test system under evaluation. Panel members were asked to assign a softness score to each cloth. To aid them in the assessment they felt 3 standard cloths whose softness had been pre-assessed as respectively 2, 5 and 8. Lower values are indicative of better softening. Water has a softness value of 8.

EXAMPLES 1–4

Examples were prepared having the following formulations:

TABLE 1

| Example No. | Active | Level wt % |
|---|---|---|
| 1 | $C_{28}$ betaine ester chloride | 5 |
| 2 | $C_{32}$ betaine ester chloride | 5 |
| 3 | $C_{34}$ betaine ester chloride | 5 |
| 4 | $C_{36}$ betaine ester chloride | 5 |

The remainder of the formulation comprises water.

| | Softness/Value |
|---|---|
| 1 | 4.75 |
| 2 | 4.75 |
| 3 | 4.25 |
| 4 | 34.5 |

EXAMPLES 5 to 8

Examples were prepared having the following formulation and softening properties.

TABLE 2

| Example | 5 | 6 | 7 | 8 |
|---|---|---|---|---|
| $C_{36}$ betaine ester | 5 | 4.75 | 4.5 | 4 |
| Genopol T250* | 0 | 0.25 | 0.5 | 1 |
| Water | 95 | 95 | 95 | 95 |
| Softness Value | 3.5 | 2.5 | 4 | 3 |

Genopol T250 (ex) is the trade name for tallow 25EO ex Hoechst.

EXAMPLES 9 to 12

To demonstrate the effect of the presence of fatty acids the following examples were prepared.

TABLE 3

| Example | 9 | 10 | 11 | 12 |
|---|---|---|---|---|
| $C_{36}$ betaine ester | 5 | 4.375 | 4.17 | 3.75 |
| Fatty Acid* | 0 | 0.625 | 0.83 | 1.25 |
| Water | 95 | 95 | 95 | 95 |
| Softness Value | 3.5 | 3.5 | 4.5 | 5.0 |

*fatty acid is Pristerine (Trade Mark) 4916 ex Unichema (hardened tallow fatty acid).

EXAMPLES 13 to 16

The following powdered formulations were prepared from 100 wt % betaine ester. Their softening properties were evaluated.

| Example | | Softness Value |
|---|---|---|
| 13 | $C_{28}$ betaine ester | 5.25 |
| 14 | $C_{32}$ betaine ester | 5.5 |
| 15 | $C_{34}$ betaine ester | 5.75 |
| 16 | $C_{36}$ betaine ester | 6 |

We claim:

1. A fabric softening composition comprising a compound of formula 1:

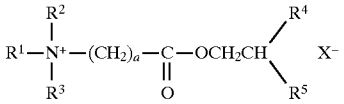

formula 1 in which $R^1$, $R^2$ and $R^3$ are independently selected from $C_1$–$C_4$ alkyl groups or $C_2$–$C_4$ alkenyl groups, a is from 1 to 4, $x^-$ is a compatible anion and $R^4$ and $R^5$ are independently selected from $C_{12}$–$C_{22}$ alkyl or alkenyl groups.

2. A fabric softening composition according to claim 1 in which $R^4$ and $R^5$ of formula 1 have chain lengths which are independently selected from $C_{12}$–$C_{22}$ alkyl or alkenyl groups and wherein the sum of the chain lengths of $R^4$ and $R^5$ of formula 1 is at least equal to 30.

3. A fabric softening composition according to claim 1 in which the alkyl or alkenyl groups $R^4$ and $R^5$ of formula 1 are predominantly linear.

4. A fabric softening composition according to claim 1 which further comprises fatty acid or fatty alcohol or mixtures thereof.

5. A fabric softening composition according to claim 4 in which the fatty acid or fatty alcohol or mixtures thereof is from about 0.1 to about 50% by weight of the compound of formula 1.

6. A fabric softening composition according to claim 1 which is in liquid form.

7. A fabric softening composition according to claim 6 which comprises from about 3 wt. % to about 50 wt. % of the compound of formula 1.

8. A fabric softening composition according to claim 6 in which $R^4$ and $R^5$ of formula 1 together have from about 34 to about 38 carbons.

9. A fabric softening composition according to claim 1 which is in powdered form.

10. A fabric softening composition according to claim 9 in which $R^4$ and $R^5$ of formula 1 together have chain lengths whose sum is less than or equal to 32.

11. A fabric softening article for use in a laundry dryer, comprising a fabric softening composition as claimed in claim 1 coated on a sheet.

12. A process for softening fabrics comprising applying a composition according to claim 1 to said fabrics.

* * * * *